US006857461B2

(12) United States Patent
Girlich et al.

(10) Patent No.: US 6,857,461 B2
(45) Date of Patent: Feb. 22, 2005

(54) METHOD AND DEVICE FOR THE PRODUCTION OF RETICULAR STRUCTURES

(76) Inventors: Dieter Girlich, Tzschimmerstr. 32, D-01309 Dresden (DE); Juergen Schaedlich-Stubenrauch, Vaalserhaagweg 4, NL-6291 Vaals (NL)

( * ) Notice: Subject to any disclaimer, the term of this patent is extended or adjusted under 35 U.S.C. 154(b) by 126 days.

(21) Appl. No.: 10/079,331

(22) Filed: Feb. 20, 2002

(65) Prior Publication Data

US 2002/0088598 A1 Jul. 11, 2002

Related U.S. Application Data

(63) Continuation of application No. PCT/DE00/02597, filed on Aug. 4, 2000.

(30) Foreign Application Priority Data

Aug. 20, 1999 (DE) ..... 199 39 155

(51) Int. Cl.[7] ..... B22C 9/04
(52) U.S. Cl. ..... 164/34; 164/35; 164/45
(58) Field of Search ..... 164/34, 35, 45, 164/235, 246

(56) References Cited

U.S. PATENT DOCUMENTS 3,616,841 A 11/1971 Walz
3,946,039 A * 3/1976 Walz ..... 264/628
3,996,991 A * 12/1976 Ugata et al. ..... 164/35

FOREIGN PATENT DOCUMENTS

JP 63-84758 * 4/1988 ..... B22D/19/00

* cited by examiner

*Primary Examiner*—M. Alexandra Elve
*Assistant Examiner*—Kevin P. Kerns
(74) *Attorney, Agent, or Firm*—Patricia M. Mathers; Thomas L. Bohan

(57) ABSTRACT

A method of producing reticular structures, particularly metallic reticular structures, as well as a device suitable for the production thereof. The method and device enable continuous and/or automated production of such structures, and particularly, large-scale automated production of large-dimensioned reticular structures. A reticulated foam pre-structure is placed into a first container and infiltrated with a refractory material. After solidification, the mold formed by the refractory material is removed from the first container and the foam pre-structure stripped from the mold. The mold is then pre-heated and placed into a second container and infiltrated with a molten substance that forms the reticular structure when solidified. The filled mold may be covered with a solid jacket as a means of controlling the rate and progression of solidification of the molten substance to form a fine-grained, bubble-free structure.

10 Claims, 2 Drawing Sheets

METHOD AND DEVICE FOR THE PRODUCTION OF RETICULAR STRUCTURES

BACKGROUND OF THE INVENTION

This invention relates to a method of producing reticular structures, and particularly, to the production of metallic reticular structures, as well as to a device suitable therefor.

Reticular structures made from metal and other materials have a wide range of application. For example, these structures can be used as lightweight structural components, battery plates, electrochemical anodes and cathodes, filters for fluids, separation devices for fluid media, heat shields, and for numerous other applications.

Numerous methods for producing such types of structures are known. Automated production of such reticulated structures, however, is extremely difficult to implement, primarily because, with the conventional methods, the reticulated foam bodies that serve as patterns or pre-structures must be bonded to wax plates. The step of bonding a foam pre-structure to a wax plate is almost impossible to automate. The bonding points are, however, indispensable, since it is through these points that the foam pattern is burned out and then, through the resulting junctions that the molten metal flows into the cavities or voids formed by the foam pre-structure.

U.S. Pat. No. 3,616,841 (Walz: issued 1971) which is viewed as the closest prior art, discloses a method for the production of an insoluble foam material with a predetermined reticulated structure. This method encompasses the steps of producing a self-supporting reticulated polyurethane foam; producing a refractory mold material by filling the voids of the polyurethane foam with a watery gypsum plaster suspension that then sets; heating the refractory mold material to a temperature of about 120° C. (250° F.) over a time period of two hours; producing voids in the refractory mold material by raising the temperature of the refractory mold material to between 535 and 815° C. (between 1,000 and 1,500° F.), in order to completely vaporize the foam and produce a mold; introducing a molten substance into the refractory mold in an amount sufficient to fill the voids which had been previously occupied by the reticulated foam pre-structure; solidifying the molten substance by reducing the temperature to below the melting point of the substance; and washing out the material that constitutes the refractory mold material. The molten substance comprises metals, metal alloys, ceramics and/or cermet.

The method disclosed by Walz has several disadvantages. The equipment required for melting the substance that is poured into the refractory mold is either very expensive, especially for melting high-melting-point metals, or is technically not feasible. Another disadvantage is that in an automated process it is very difficult to control the bonding of the foam to the wax plate. This step is critical, however, for controlling the quality of the final product, as the quality of the bonding between foam and wax plate determines the structure of the foam pre-structure, which, in turn, determines the technical parameters such as surface smoothness or dimensional accuracy, of the end product. Thus, in order to reliably obtain an end product that corresponds to specification with regard to surface smoothness or dimensional accuracy or other parameters, it is imperative that this step be controllable in order to restrict the statistical range of fluctuation in the structure of the foam as much as possible.

To form the reticular structure, molten metal is poured into the refractory mold, which consists of branched voids.

With the Walz method, in order to ensure that the molten metal remains liquid long enough to flow through the branches and completely fill the voids, the mold material must be heated to a temperature higher than that of the melting point of the molten metal. As a result, the solidification of the molten metal progresses very slowly, resulting in a solidified metal with a coarse grainy texture and reduced strength properties.

To solve this problem, Walz suggests various cooling methods, such as, for example, spraying the mold with water or air. A problem with such cooling methods is that the mold hinders the flow of heat, thereby significantly diminishing the cooling effect. Moreover, the production of massive or solid areas of metal together with the reticular structure is related to the problem of a very slow cooling progress. In order to obtain a bubble-free and fine-grained texture, it is imperative that the solidification process of the reticular structure be a controlled process. The method steps disclosed in Walz do not provide a means for effective control over the solidification process. The Walz method has an inherent economic disadvantage that limits the success or feasibility of automating production processes for reticular structures, in that the slow progression of the solidification of the metal results in long process times.

What is needed, therefore, is an automated method of production of reticular structures, particularly, metallic reticular structures. What is further needed, is such a method that produces a reticular structure having a fine-grained and bubble-free texture. What is yet further needed is such a method that allows large-scale production of metallic reticular structures, including large-dimensioned reticular structures.

SUMMARY OF THE INVENTION

For the reasons cited above, it is an objective of the present invention to simplify the production of a reticular structure so as to enable automated production. It is a further objective to enable large-scale production of reticular structures, including metallic and/or large-dimensioned reticular structures. It is a yet further objective to enable production of reticular structures having a fine-grained, bubble-free texture.

The objectives are achieved according to the present invention by providing an automated method of producing reticular structures, including large-scale production of metallic and/or large-dimensioned reticular structures and by providing a device for the production of same.

With the method of the present invention, a foam pattern or pre-structure is used to create a refractory mold. The foam pre-structure is placed in a refractory container and infiltrated with a refractory mold material, typically a gypsum plaster suspension. After the mold material has solidified, the resulting mold, including pre-structure, is withdrawn from the refractory container and the pre-structure removed from the mold by volatilization. The mold is then preheated to a temperature greater than the melting point of the molten substance that will form the reticular structure and placed inside a heat-resistant container. The molten substance for metallic reticular structures may comprise metals, alloys, ceramics, cermet materials, and/or any suitable combination thereof.

A key feature of the method and device according to the present invention is that the heat-resistant container is greater in size than the size of the pre-heated mold when it is filled with the molten substance. After the mold is placed in the heat-resistant container and filled with the molten substance, a solid jacket or shell is then poured over the filled mold, filling a gap between the filled mold and the wall of the container. The container wall is temperature-controlled and maintained at a temperature that is lower than the melting point of the molten substance. Since the jacket is in direct contact with the container wall, heat is drawn from the mold through the jacket into the wall and, as a result, cooling begins at the outer perimeter and progresses inward toward the center of the mold. After the molten substance has solidified, the mold is removed from the heat-resistant container and stripped or removed from the cast reticular structure. The ability to control the temperature of the heat-resistant container and of the refractory mold promotes bubble-free solidification of the molten metal.

The method according to the invention offers several advantages. It is no longer necessary to bond the foam pre-structure to the running system and sprue cup. This substantially reduces the time and material required to produce the casting mold. Because large areas of the foam pre-structure are no longer bonded to the running system, the method also eliminates an inherent source of error that resulted from the uncontrollable method of bonding the pre-structure to the running system. The method according to the invention is also economical, as only the amount of refractory material that is required to produce the mold for the actual reticular structure is used, thus reducing to a minimum the amount of refractory material used in the production of the reticular structure.

The method according to the invention provides additional advantages that improve the quality assurance for the structures. For example, following withdrawal from the first container, the foam pre-structure protrudes from the refractory mold. This simplifies and improves visual monitoring as to whether, after the foam pre-structure is volatilized, the ligaments and cells formed from the pre-structure will be sufficiently well set externally to ensure a complete casting of the reticular structure. Moreover, the accessibility to all sides of the foam pre-structure promotes rapid, even heating of the refractory mold. Ready access to the ligaments and cells of the foam structure also promotes rapid volatilization of the foam pre-structure. After the pre-structure has been volatilized, it is also easier to monitor whether the ligaments provide sufficient means of access of the molten metal to the internal structure, that is, to the "negative mold."

The method according to the invention does not require the use of the wax plates to bond the foam pre-structure, as do conventional methods, and allows continuous automated, large-scale production of reticular structures. Examples of suitable uses of the metallic reticular structures obtained from the production method according to the invention, include use as catalysts for EMC shielding and in batteries. For example, in the production of a reticular structure for use in a catalytic converter for the combustion stabilization of diesel fuel, the refractory mold is filled with a molten metal comprising a Zn/Cu alloy. Reticular structures produced according to the method of the invention and made of aluminum and then coated with lead are used, for example, in batteries.

DETAILED DESCRIPTION OF THE INVENTION

Figure 1:
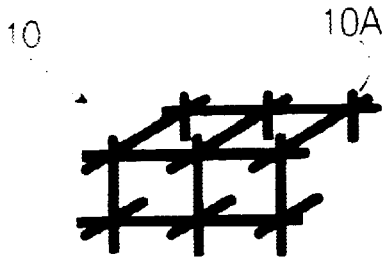
FIG. 1 illustrates the foam pre-structure that can also be coated.
Figure 2:
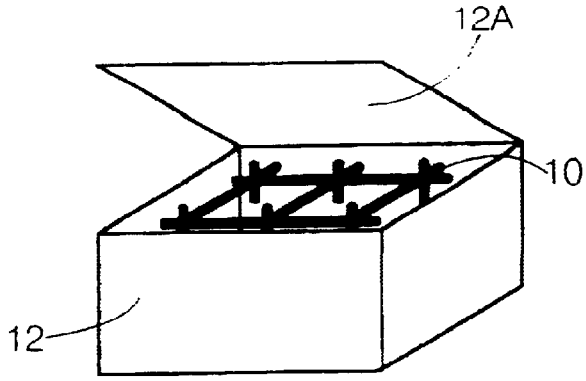
FIG. 2 shows the openable container with cover, in which the foam pre-structure is placed according to the method of the present invention.
Figure 3:
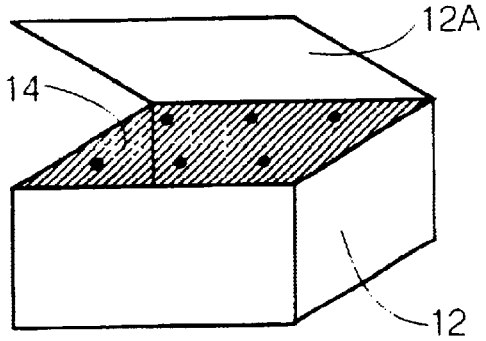
FIG. 3 shows the openable container containing the foam pre-structure, whereby the openable container has been filled with the refractory mold material .
Figure 8:
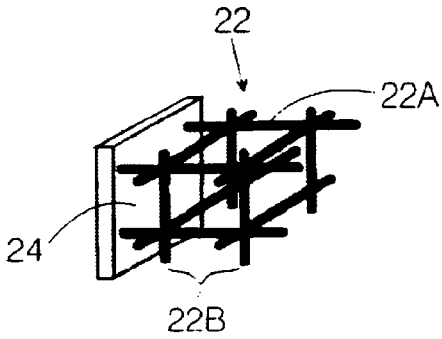
FIG. 8 shows the reticular structure, formed according to the method and device of the present invention, with a partial jacket casting abutting the reticular structure.
Figure 1:
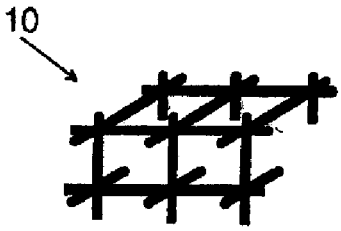
Figure 2:
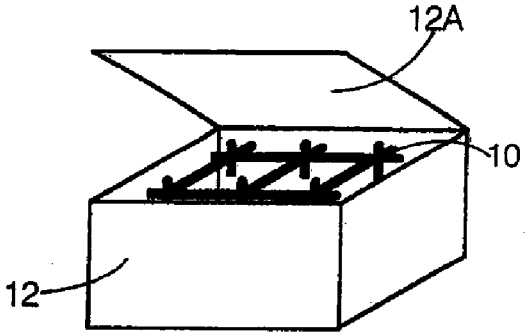
Figure 3:
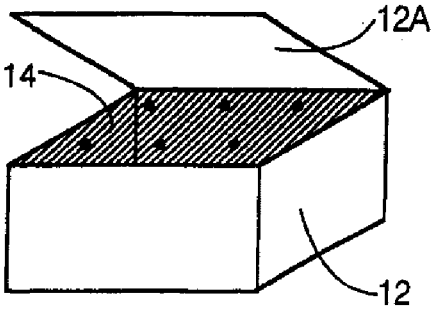
Figure 4:
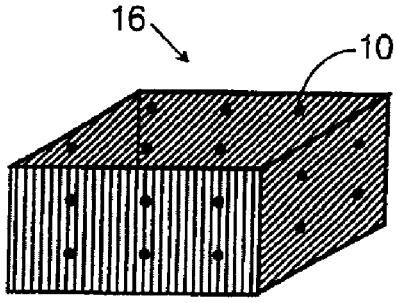
Figure 5:
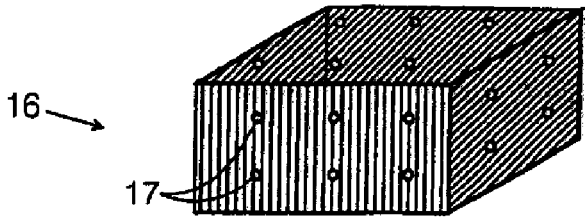
Figure 6:
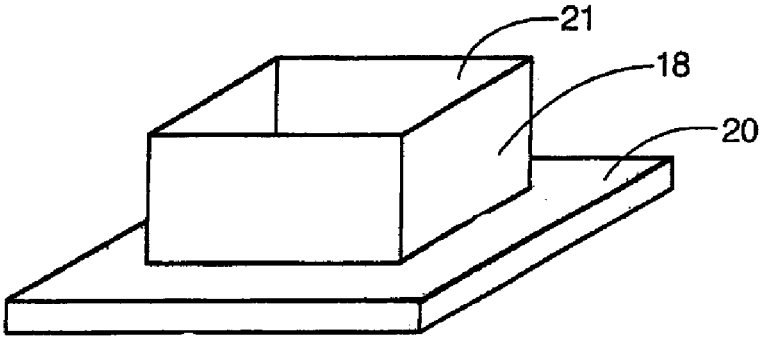
Figure 7:
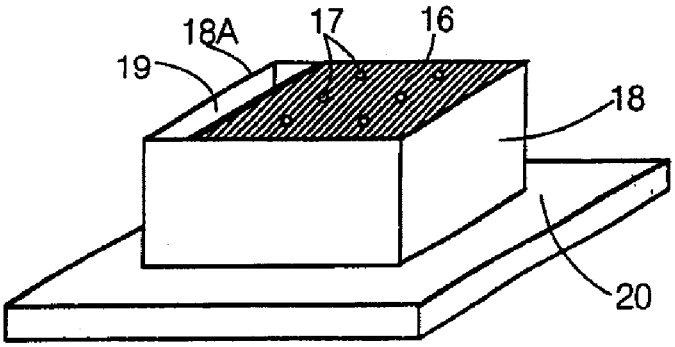
Figure 8:
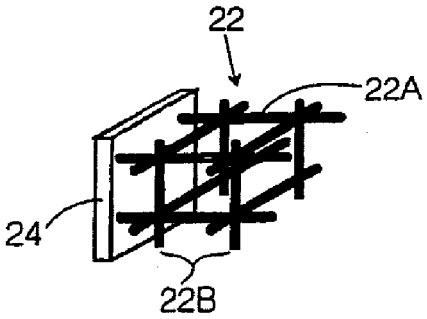

To form a reticular structure 22, shown in FIG. 8, according to the method of the present invention, a reticulated foam pre-structure 10 is placed in an openable container 12 having a container lid 12A, as illustrated by FIGS. 1 and 2. Preferably, the material used for the pre-structure material 10 is polyurethane foam, although any material that provides a sufficient number of pores is suitable for use as the pre-structure material. The foam pre-structure 10 is then infiltrated with a refractory mold material 14, as shown in FIG. 3. The container lid 12A is closed for applying a vacuum to the openable container 12. The refractory mold material 14 is allowed to solidify to form a refractory mold 16. Preferably, the refractory mold material 14 is a watery gypsum plaster suspension.

The surface of the foam pre-structure 10 is modifiable, preferably by roughening or structuring the surface of the foam pre-structure 10 after it has been placed in the openable container 12. Pneumatic or vacuum assistance may be used to force the refractory mold material 14 into the container 12 to ensure that the material 14 completely encases the pre-structure 10.

Figure 4:
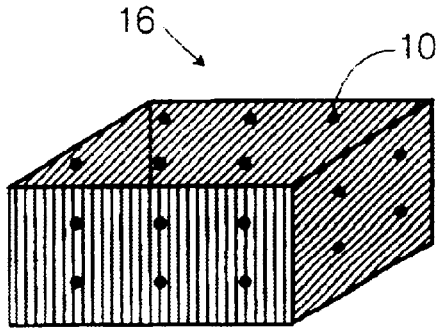
FIG. 4 shows the refractory mold material with the foam pre-structure.
Figure 5:
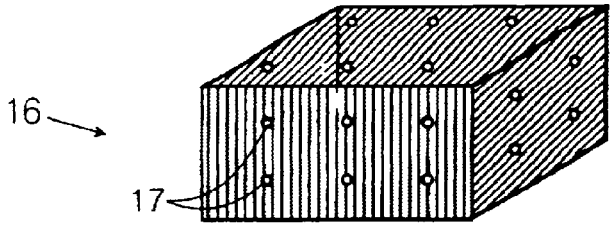
FIG. 5 shows a refractory mold and the cavities that remain when the foam pre-structure has been removed from the set mold material.

After solidification, the refractory mold 16, along with the foam pre-structure 10, shown in FIG. 4, is withdrawn from the openable container 12, and the foam pre-structure 10 stripped or removed from the refractory mold 16. FIG. 5 shows the refractory mold 16, including the voids 17 formed by the foam pre-structure 10.

Figure 6:
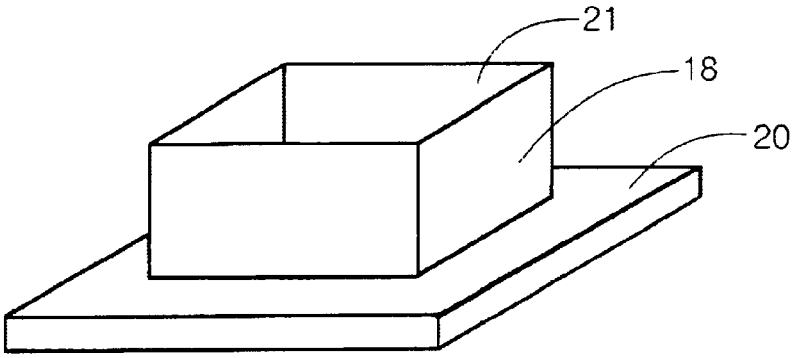
FIG. 6 shows the device according to the present invention, including a cooling plate.
Figure 7:
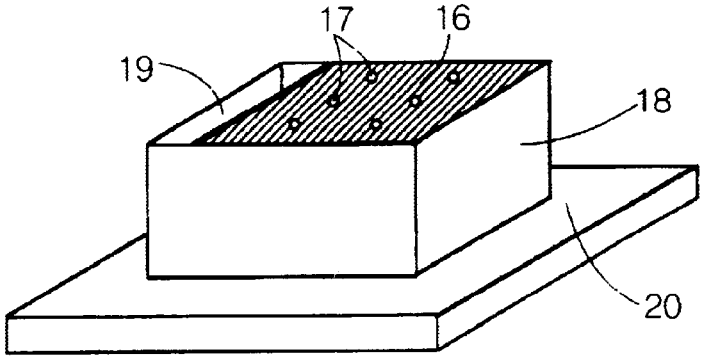
FIG. 7 shows the device of FIG. 6 on the cooling plate, with the refractory mold placed in the device, the heat-resistant container, whereby the refractory mold is geometrically smaller than the device.

FIG. 6 shows the device according to the present invention, which is a heat-resistant container 18 mounted on a cooling plate 20. The refractory mold 16 is pre-heated and placed into the heat-resistant container 18. As shown in FIG. 7, the heat-resistant container 18 is geometrically larger than the mold 16. The difference in dimensions between the heat-resistant container 18 and the mold 16 results in a gap 19 between the mold 16 and the heat-resistant container 18. The mold 16 is then infiltrated with a molten substance that fills the voids 17 in the mold 16, thereby forming a reticular structure 22, as shown in FIG. 8. Any suitable casting material may be used in the method according to the present invention. For metallic reticular structures, the molten substance comprises preferably metals, alloys, ceramics, metal ceramics, and/or any suitable combination thereof. After the molten substance has solidified, the reticular structure 22 is withdrawn from the heat-resistant container 18 and the refractory mold 16 removed from the structure 22.

As can be seen in FIG. 8, the reticular structure 22 corresponds in shape to the foam pre-structure 10. Also shown in FIG. 8 is a plate 24 that is formed when a casting material is poured over the mold 16 that is filled with the molten substance and fills the gap 19 between the heat-resistant container 18 and the mold 16.

The heat-resistant container 18 according to the invention holds the mold 16 and has at least one opening 21 for pouring the molten metal into the refractory mold 16. Preferably, the interior space of the container 18 is larger than the pre-heated refractory mold 16 filled with the molten substance, in order to provide a gap between a container wall 18A of the container and the refractory mold 16. The size of the gap is freely-selectable and is determined by the difference in size between the heat-resistant container 18 and the filled, pre-heated refractory mold 16. After pouring the molten substance into the mold 16, a solid jacket or shell is then cast onto the structure, i.e., the refractory mold 16 filled with the molten substance, thereby filling the gap 19 between the structure and the container 18. The container 18 is temperature-controlled and maintained at a temperature that is cooler than that of the molten metal and the pre-heated refractory mold 16. Since the jacket is in direct contact with the container 18, heat is drawn from the casting metal directly into the container 18 during the solidification process, allowing the structure 22 to cool from the outside inward toward the center of the refractory mold 16, thereby producing a cast structure with a fine grain and, also, producing optimal bonding between ligaments 22A of the reticular structure 22 and the solid shell. The reticular structure 22 that is obtained after solidification of the molten substance can then be cleaned and is modifiable, for example, by applying a conventional coating to the structure 22.

The reticular structures 22 produced by the method according to the invention, including the use of the heat-resistant container 18, can be integrated into castings that are produced by various casting methods, such as, for example, die casting, permanent-mold casting, centrifugal casting, low-pressure casting or back-pressure casting. The reticular structures themselves can also be cast by these methods.

The method according to the invention enables automated production of reticular structures 22 of the most varying degrees of fineness with respect to the thickness of ligaments 22A and the size of cells 22B. Combinations of various cell sizes and ligament thicknesses within one structure 22 are also possible.

The method and device according to the invention described herein are merely illustrative of the present invention. It should be understood that variations in the steps of the method and construction of the device may be contemplated in view of the following claims without straying from the intended scope and field of the invention herein disclosed.

What is claimed is:

1. A method of producing a reticular structure, said method comprising the steps of:

a) placing a reticulated foam pre-structure into a first container having a lid;

b) infiltrating said foam pre-structure with a refractory mold material;

c) solidifying said refractory material to form a refractory mold;

d) withdrawing said refractory mold along with said foam pre-structure from said first container;

e) removing said foam pre-structure from said refractory mold;

f) placing said refractory mold into a second container having at least one opening for pouring in a molten substance and at least one wall, wherein said second container is greater in size than said refractory mold so as to leave a gap between said refractory mold and said at least one wall;

g) infiltrating said refractory mold with said molten substance to form a reticular structure;

h) pouring a jacket material over said refractory mold so as to fill said gap with said jacket material to form a plate;

i) cooling said reticular structure by maintaining a temperature of said second container, and particularly of said at least one wall, that is lower than a temperature of said molten substance so as to draw heat from said reticular structure into said second container, and particularly through said plate; and j) after said molten substance has solidified, withdrawing said reticular structure from said second container and removing said refractory mold from said reticular structure.

2. The method of producing a reticular structure according to claim 1, wherein, after said step of withdrawing said refractory mold from said first container, said foam pre-structure protrudes from said refractory mold.

3. The method of producing a reticular structure according to claim 1, wherein said foam pre-structure has a surface and wherein, subsequent to step a), said method includes a step of modifying said surface by roughening.

4. The method of producing a reticular structure according to claim 1, wherein said foam pre-structure has a surface and wherein, subsequent to step a), said method includes a step of modifying said surface by texturing.

5. The method of producing a reticular structure according to claim 1, wherein said reticular structure has a structure surface and wherein, subsequent to step h), said method includes a step of modifying said structure surface by applying a coating to said structure surface.

6. The method of claim 1, wherein said reticular structure is a metallic reticular structure and said molten substance is a molten metallic substance comprising materials from a group consisting of metals, metal alloys, ceramics and cermet.

7. The method of claim 1, wherein said foam pre-structure is a polyurethane foam.

8. The method of claim 1, wherein said refractory mold material comprises a gypsum plaster suspension.

9. The method of claim 1, wherein said first container is made of a refractory material.

10. The method of claim 1, wherein said second container is made of a heat-resistant material.

* * * * *

UNITED STATES PATENT AND TRADEMARK OFFICE

CERTIFICATE OF CORRECTION

PATENT NO. : 6,857,461 B2 
DATED : February 22, 2005
INVENTOR(S) : Dieter Girlich & Juergen Schaedlich-Stubenrauch It is certified that error appears in the above-identified patent and that said Letters Patent is hereby corrected as shown below:

The title page, should be deleted and substitute therefor the attached title page as shown on the attached pages.

Delete drawing sheets 1-2, and substitute therefore the drawing sheets, consisting of Figs 1-8, as shown on the attached pages Signed and Sealed this Twelfth Day of July, 2005

JON W. DUDAS
*Director of the United States Patent and Trademark Office*

(12) United States Patent
Girlich et al.

(10) Patent No.: US 6,857,461 B2
(45) Date of Patent: Feb. 22, 2005

(54) METHOD AND DEVICE FOR THE PRODUCTION OF RETICULAR STRUCTURES

(76) Inventors: Dieter Girlich, Tzschimmerstr. 32, D-01309 Dresden (DE); Juergen Schaedlich-Stubenrauch, Vaalserhaagweg 4, NL-6291 Vaals (NL)

( * ) Notice: Subject to any disclaimer, the term of this patent is extended or adjusted under 35 U.S.C. 154(b) by 126 days.

(21) Appl. No.: 10/079,331

(22) Filed: Feb. 20, 2002

(65) Prior Publication Data

US 2002/0088598 A1 Jul. 11, 2002

Related U.S. Application Data

(63) Continuation of application No. PCT/DE00/02597, filed on Aug. 4, 2000.

(30) Foreign Application Priority Data

Aug. 20, 1999 (DE) ..... 199 39 155

(51) Int. Cl.[7] ..... B22C 9/04
(52) U.S. Cl. ..... 164/34; 164/35; 164/45
(58) Field of Search ..... 164/34, 35, 45, 164/235, 246

(56) References Cited

U.S. PATENT DOCUMENTS 3,616,841 A 11/1971 Walz
3,946,039 A * 3/1976 Walz ..... 264/628
3,996,991 A * 12/1976 Ugata et al. ..... 164/35

FOREIGN PATENT DOCUMENTS

JP 63-84758 * 4/1988 ..... B22D/19/00

* cited by examiner

*Primary Examiner*—M. Alexandra Elve
*Assistant Examiner*—Kevin P. Kerns
(74) *Attorney, Agent, or Firm*—Patricia M. Mathers; Thomas L. Bohan

(57) ABSTRACT

A method of producing reticular structures, particularly metallic reticular structures, as well as a device suitable for the production thereof. The method and device enable continuous and/or automated production of such structures, and particularly, large-scale automated production of large-dimensioned reticular structures. A reticulated foam pre-structure is placed into a first container and infiltrated with a refractory material. After solidification, the mold formed by the refractory material is removed from the first container and the foam pre-structure stripped from the mold. The mold is then pre-heated and placed into a second container and infiltrated with a molten substance that forms the reticular structure when solidified. The filled mold may be covered with a solid jacket as a means of controlling the rate and progression of solidification of the molten substance to form a fine-grained, bubble-free structure.

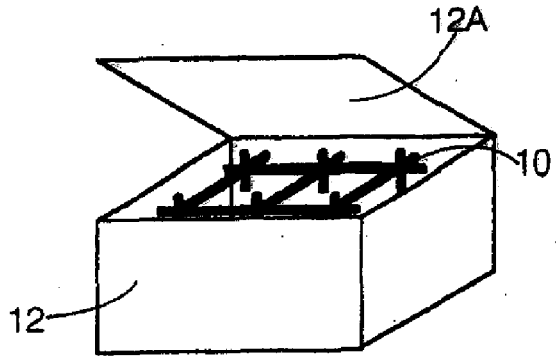

10 Claims, 2 Drawing Sheets